US010283902B2

(12) United States Patent
Hamada et al.

(10) Patent No.: US 10,283,902 B2
(45) Date of Patent: May 7, 2019

(54) WATERPROOF STRUCTURE FOR CONNECTOR

(71) Applicants: YAZAKI CORPORATION, Tokyo (JP); HONDA MOTOR CO., LTD., Tokyo (JP)

(72) Inventors: Keiji Hamada, Tochigi (JP); Tomoyuki Miyakawa, Tochigi (JP); Kazuyuki Ochiai, Saitama (JP)

(73) Assignees: YAZAKI CORPORATION, Tokyo (JP); HONDA MOTOR CO., LTD., Tokyo (JP)

( * ) Notice: Subject to any disclaimer, the term of this patent is extended or adjusted under 35 U.S.C. 154(b) by 0 days.

(21) Appl. No.: 15/886,768

(22) Filed: Feb. 1, 2018

(65) Prior Publication Data

US 2018/0191099 A1 Jul. 5, 2018

Related U.S. Application Data

(63) Continuation of application No. PCT/JP2016/075407, filed on Aug. 31, 2016.

(30) Foreign Application Priority Data

Aug. 31, 2015 (JP) ..... 2015-170926
Aug. 31, 2015 (JP) ..... 2015-171305

(51) Int. Cl.
*H01R 13/627* (2006.01)
*H01R 13/52* (2006.01)

(52) U.S. Cl.
CPC ..... *H01R 13/5219* (2013.01); *H01R 13/52* (2013.01)

(58) Field of Classification Search
CPC ..... H01R 13/6275; H01R 13/6272
(Continued)

(56) References Cited

U.S. PATENT DOCUMENTS 3,124,405 A * 3/1964 Massa ..... H01R 13/523 174/91
3,611,255 A * 10/1971 Shroyer ..... H01R 13/50 439/282

(Continued)

FOREIGN PATENT DOCUMENTS

CN 1196609 C 4/2005
JP 2003-115353 A 4/2003

(Continued)

OTHER PUBLICATIONS

International Search Report and Written Opinion of the International Search Report for PCT/JP2016/075407 dated Nov. 22, 2016.

(Continued)

*Primary Examiner* — Thanh Tam T Le
(74) *Attorney, Agent, or Firm* — Kenealy Vaidya LLP

(57) ABSTRACT

In a waterproof structure for a connector, in order to prevent that water is infiltrated into openings of cavities accommodating terminals, a pair of housings include resin annular members which protrude in a fitting direction to surround the openings. One annular member has a protrusion part which is formed on a way between a tip and a root thereof over an entire circumference. The protrusion part is formed to have a top part which presses an inner circumferential surface or an outer circumferential surface of the counterpart annular member at a time of fitting the pair of housings.

7 Claims, 16 Drawing Sheets

(58) Field of Classification Search
USPC ..... 439/350, 352, 357, 660
See application file for complete search history.

(56) References Cited

U.S. PATENT DOCUMENTS

| | | | | |
|---|---|---|---|---|
| 4,441,776 | A * | 4/1984 | Anhalt | H01R 13/6272 439/266 |
| 5,632,651 | A | 5/1997 | Szegda | |
| 6,336,821 | B1 * | 1/2002 | Hattori | H01R 13/17 439/282 |
| 6,561,834 | B2 * | 5/2003 | Chen | H01R 13/6272 439/357 |
| 7,479,025 | B2 * | 1/2009 | Lee | H01R 13/6277 439/349 |
| 7,481,673 | B1 * | 1/2009 | Qu | H01R 13/5219 439/578 |
| 7,553,185 | B1 * | 6/2009 | Qu | H01R 13/5219 439/578 |
| 7,758,370 | B1 * | 7/2010 | Flaherty | H01R 13/6275 439/352 |
| 8,087,954 | B2 * | 1/2012 | Fuchs | H01R 13/5219 439/352 |
| 8,357,004 | B2 * | 1/2013 | Tao | H01R 13/64 439/352 |
| 8,591,247 | B2 * | 11/2013 | Zhu | H01R 13/6273 439/352 |
| 8,597,043 | B2 * | 12/2013 | Zhao | H01R 13/707 307/10.1 |
| 2002/0173193 | A1 | 11/2002 | Nishimoto | |
| 2005/0136735 | A1 | 6/2005 | Rodrigues et al. | |

FOREIGN PATENT DOCUMENTS

| | | | |
|---|---|---|---|
| JP | 2003-257539 | A | 9/2003 |
| JP | 2005-310763 | A | 11/2005 |
| JP | 4598327 | B2 | 12/2010 |
| JP | 2013-229168 | A | 11/2013 |
| JP | 2013-239367 | A | 11/2013 |

OTHER PUBLICATIONS

International Preliminary Report on Patentability and English language Written Opinion of the International Search Report for PCT/JP2016/075407 dated Mar. 6, 2018.

Chinese Office Action for the related Chinese Patent Application No. 201680049588.7 dated Jan. 30, 2019.

The extended European Search Report for the related European Patent Application No. 16841880.4 dated Mar. 1, 2019.

* cited by examiner

WATERPROOF STRUCTURE FOR CONNECTOR

TECHNICAL FIELD

The present invention relates to a waterproof structure for a connector.

BACKGROUND ART

In the related art, a waterproof connector which connects wires is mounted in an automobile and the like. For example, a connector is known which includes a female connector, which has a cylindrical inner housing in which a cavity capable of accommodating a female terminal is formed and a cylindrical outer housing which surrounds the inner housing, and a male connector, which has a cylindrical male housing in which a cavity capable of accommodating a male terminal is formed. The connector is formed by fitting both the female and the male connectors.

In such a kind of connector, an annular rubber packing is mounted in an outer circumferential surface of the inner housing of the female connector. When the both connectors are fitted with each other, the male housing is inserted into a gap between the inner housing and the outer housing of the female connector, and the packing is brought into close contact with each of the outer circumferential surface of the inner housing and the inner circumferential surface of the male housing. Thus, it is prevented that water is infiltrated into the gap between the cavities.

However, such a kind of waterproof structure has a problem that the outer diameter dimension of the connector is enlarged since a space for mounting the packing is necessary inside the female connector. With regard to this, for example, as a waterproof structure which does not use a packing, a structure is known in which a resin seal plate having an elasticity is provided in an inner surface of the depth side of a female housing, and a cylinder tip of a male housing in a fitting direction abuts on the seal plate of the female housing over the entire circumference which has an annular shape when both connectors are fitted, thereby preventing the infiltration of water (for example, see Patent Literature 1).

CITATION LIST

Patent Literature

[Patent Literature 1]: JP-A-2013-229168

SUMMARY OF THE INVENTION

Technical Problem

However, in the waterproof structure of Patent Literature 1, when the male housing abuts on the seal plate, an excessive load may occur at least in one of both housings. For example, in a case where a predetermined dimension difference or more occurs in one housing, or in a case where a foreign matter or the like adheres to the gap between the male housing and the seal plate, there is a concern that the male housing is plastically deformed over an elastic limit when the male housing is pushed to the seal plate, whereby a waterproof performance is deteriorated.

The invention has been made in view of the above-described problem and an object thereof is to provide a waterproof structure for a connector which achieves improvement for a waterproof performance at the time of fitting housings and enables the connector to be miniaturized.

Solution to Problem

In order to achieve the above-described object, a waterproof structure for a connector according to the invention is characterized by following (1) to (7).

(1)

A waterproof structure for a connector which prevents that water is infiltrated into openings of terminal accommodating cavities which are respectively formed in a pair of housings fitted to each other, in which the pair of housings include annular members protruding in a fitting direction to surround the opening, the annular member of one housing being inserted into an annulus of the annular member of the other housing at a time of fitting, and the at least one annular member includes a protrusion part which is an annular protrusion part protruding toward the other annular member and has a top part which is pressed by a surface of the other annular member at the time of fitting.

(2)

The waterproof structure for a connector according to the above-described (1), in which the protrusion part is formed such that a sectional shape of the top part in a cross section orthogonal to a circumferential direction of the annular member is an arc shape.

(3)

The waterproof structure for a connector according to the above-described (1) or (2), in which the protrusion part includes a tilted surface which is tilted from the top part toward a protruding end of the annular member.

(4)

The waterproof structure for a connector according to any one of the above-described (1) to (3), in which an inner circumferential surface of one annular member is formed with an annular first protrusion part which protrudes to contact an outer circumferential surface of the other annular member, the outer circumferential surface of the other annular member is formed with an annular second protrusion part which protrudes to contact the inner circumferential surface of the one annular member, and the first protrusion part and the second protrusion part are arranged to be deviated from each other at the time of fitting.

(5)

The waterproof structure for a connector according to the above-described (4), in which any one of the first protrusion part and the second protrusion part has a shape which regulates movement of the other in a fitting release direction at the time of fitting.

(6)

The waterproof structure for a connector according to the above-described (4) or (5), in which any one of the first protrusion part and the second protrusion part has a sectional shape which has a plurality of crest parts in a cross section orthogonal to a circumferential direction thereof, and the other of the first protrusion part and the second protrusion part is positioned in a valley part between the adjacent crest parts at the time of fitting.

(7)

The waterproof structure for a connector according to any one of the above-described (4) to (6), in which any one of the first protrusion part and the second protrusion part is formed in a connecting end of the annular member with a main body of the housing, and the other of the first protrusion part and the second protrusion part presses the surface of the annular member between the connecting end and the protruding end of the annular member.

According to the waterproof structure for a connector configured as the above-described (1), in a case where the pair of housings are fitted, the annular members formed respectively in the housings are overlapped with each other with the protrusion part interposed therebetween, and the any one annular member is pressed by the other annular member. When the pair of annular members are pushed to each other under a limit of an elastic deformation, a plastic deformation does not occur in the annular members. Accordingly, it is possible to prevent that water is infiltrated into the opening, and to improve the waterproof property of the connector. In addition, since the annular members directly contact each other, a space for providing the rubber packing is not necessary in the connector, and thus it is possible to miniaturize the connector.

Incidentally, when one annular member is inserted into the annulus of the other annular member, or the insertion is performed in a state where the inner circumferential surface and the outer circumferential surface of the pair of annular members directly contact each other, a large frictional force may occur between the inner circumferential surface and the outer circumferential surface, and a force (insertion load) necessary for the insertion becomes large. In the invention, the annular protrusion part is formed in the annular member, and thus an area where the annular members contact each other is limited to the top part of the protrusion part. Accordingly, it is possible to reduce the insertion load, and to improve the assembly operability of the connector.

According to the waterproof structure for a connector configured as the above-described (2), the contact area of the annular members can be small, and thus the insertion load can be small further.

According to the waterproof structure for a connector configured as the above-described (3), when the pair of housings are fitted, one annular member is placed on the protrusion part along the tilted surface of the protrusion part of the other annular member, and thus it is possible to reliably prevent the plastic deformation or the breakage caused by the contact between the annular members.

According to the waterproof structure for a connector configured as the above-described (4), the first protrusion part and the second protrusion part are formed in the inner circumferential surface of one annular member and the outer circumferential surface of the other annular member, and the waterproof structure can be formed in the gap between the annular members. In addition, the first protrusion part and the second protrusion part are provided to be deviated in position from each other, and thus it is possible to lengthen the depth length of the waterproof structure. Accordingly, it is possible to prevent that water is infiltrated into the openings through the gap between the annular members.

In the first protrusion part and the second protrusion part, preferably, at least one is set to have such a height that pushes the inner circumferential surface or the outer circumferential surface of the other annular member. With such a setting, for example, one annular member pushed to the other annular member to be deformed elastically, and presses the other annular member by the restoring force of the elastic deformation at that time. If the annular members are pushed to each other under an elastic limit, the plastic deformation does not occur in the annular members. Accordingly, it is possible to prevent that water is infiltrated between the annular members, and to improve the waterproof performance of the connector.

According to the waterproof structure for a connector configured as the above-described (5), a state where the annular members are overlapped with each other can be maintained, and unintended release of fitting can be prevented. Thus, it is possible to improve and maintain the waterproof property between the annular members.

According to the waterproof structure for a connector configured as the above-described (6), the first protrusion part can be engaged with the second protrusion part. Thus, for example, even in a case where the connector vibrates, the pair of annular members are expanded and contracted integrally, so that it is possible to prevent the deterioration of the waterproof property between the annular members.

According to the waterproof structure for a connector configured as the above-described (7), when the annular members are overlapped with each other, it is prevented that the other annular member gets over one annular member. Thus, it is possible to reduce the fitting load (insertion load) at the time of fitting the pair of housings.

Advantageous Effects of the Invention

In the invention, the waterproof structure for a connector can be provided which achieves improvement of the waterproof performance at the time of fitting the housings to each other, and enables the connector to be miniaturized.

DESCRIPTION OF EMBODIMENTS (First Embodiment)

Hereinafter, a first embodiment of a waterproof structure for a connector to which the invention is applied will be described with reference to FIGS. 1 to 8. In this embodiment, a waterproof connector mounted in an automobile and the like is described as an example, but the connector of the invention can be applied also to a connector for another purpose.

Figure 1:
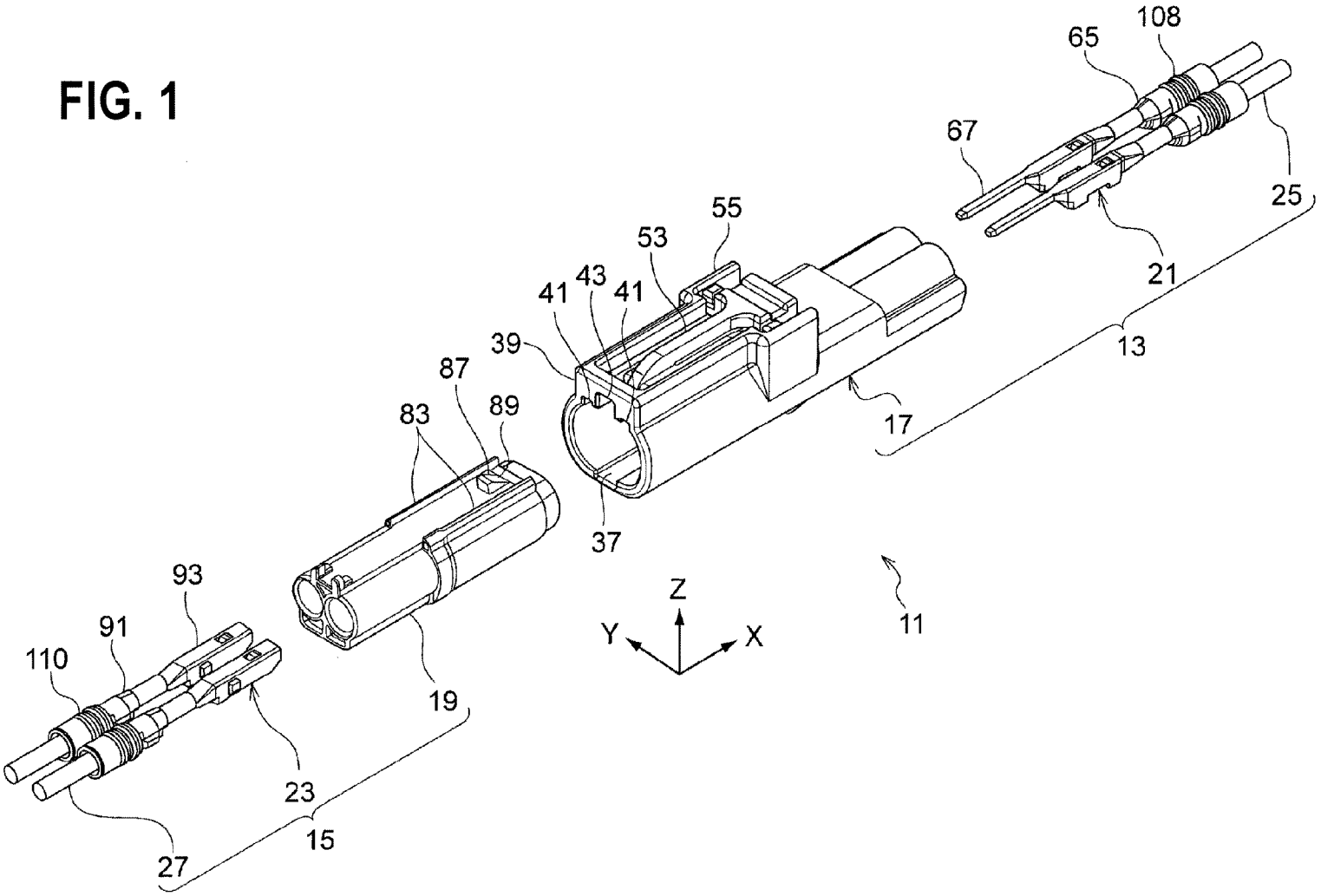
FIG. 1 is an exploded perspective view of a connector of a first embodiment.
Figure 2:
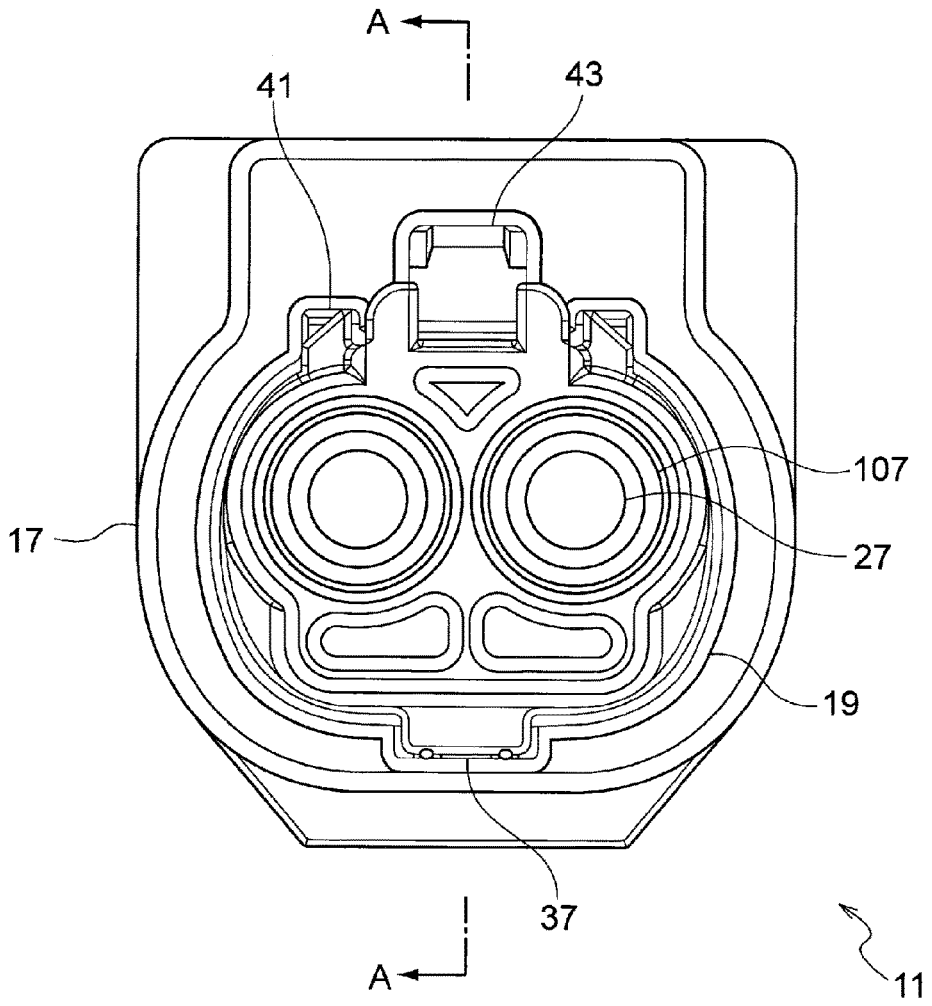
FIG. 2 is a view of the connector of FIG. 1 when viewed from a side of a back surface of a female connector.

As illustrated in FIGS. 1 and 2, the connector 11 of this embodiment is configured by a male connector 13 and a female connector 15. A male housing 17 of the male connector 13 and a female housing 19 of the female connector 15 are fitted to each other, and a male terminal 21 accommodated by the male housing 17 and a female terminal 23 accommodated by the female housing 19 are connected electrically. A wire 25 is connected in the male terminal 21, and a wire 27 is connected in the female terminal 23. The female housing 19 is locked by being fitted into the male housing 17. In this embodiment, an example is described in which two terminals are accommodated in each of the connectors, but the number of the accommodated terminals is not limited to two. Incidentally, in following description, a X direction of FIG. 1 is defined as a front and rear direction, a Y direction is defined as a width direction, a Z direction is defined as a height direction, a fitting direction of both connectors is defined as a front side, and an upper side of FIG. 1 is defined as an upper side.

Figure 3:
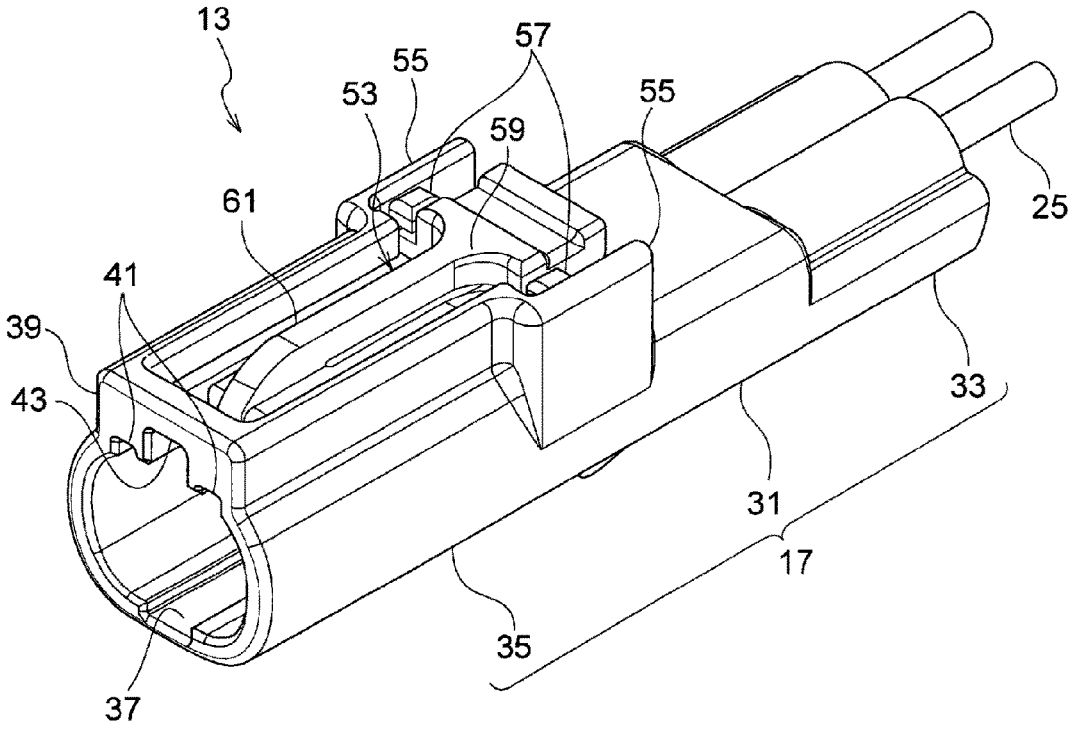
FIG. 3 is a perspective view of an appearance of a male connector.
Figure 6:
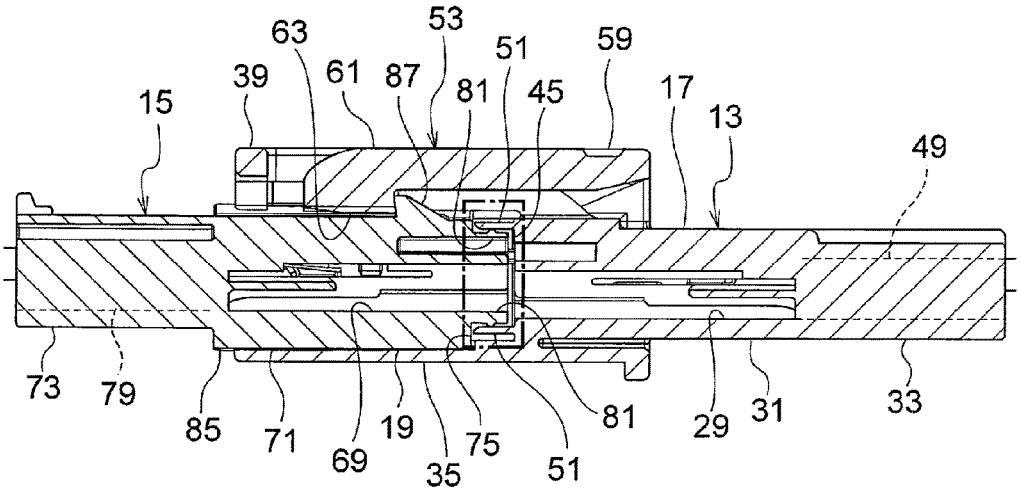
FIG. 6 is a sectional view taken along line A-A of FIG. 2.

The male connector 13 includes the male housing 17 which is formed of an insulating synthetic resin in a cylindrical shape, and the male terminal 21 accommodated from a rear side by the male housing 17. As illustrated in FIGS. 3 and 6, the male housing 17 integrally includes a cylindrical base part 31 which is formed with a male terminal accommodating chamber 29 (cavity) accommodated by the male terminal 21, a wire holding part 33 which protrudes rearward from the base part 31, and a hood part 35 which protrudes forward from the base part 31. The hood part 35 has a circumferential wall continuous to a circumferential wall of the base part 31, and is formed in an elliptical cylindrical shape in which a cross section orthogonal to an axial direction has a longitudinal side in a width direction.

As illustrated in FIG. 3, a guide groove 37 which extends in the axial direction is formed in the inner wall of the hood part 35. A pair of first notch parts 41 and a second notch part 43 formed between the pair of first notch parts 41 are provided in a wall part 39 which stands to flush with a front end surface of the hood part 35 in a plate shape.

Figure 4:
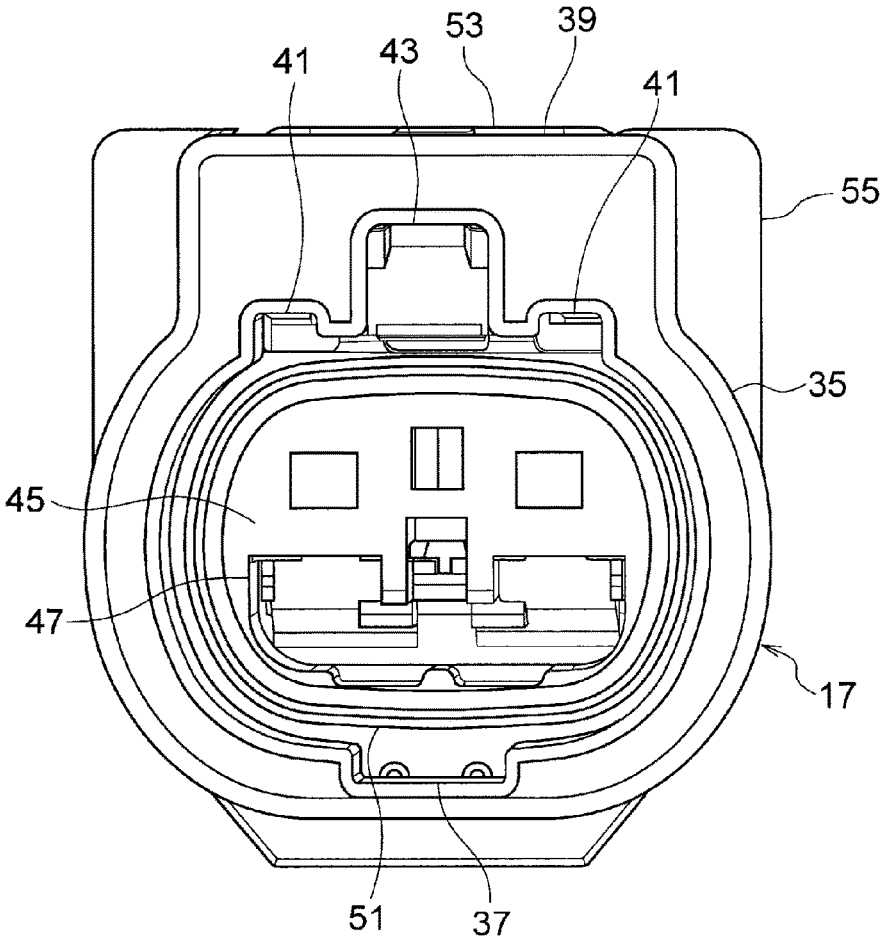
FIG. 4 is a front view of a male housing configuring the male connector of FIG. 3.

The male terminal accommodating chamber 29 accommodates two male terminals 21 partitioned by a partition wall (not illustrated), and holds the male terminals 21 in a setting position by engaging a lance (not illustrated) extending in the male terminal accommodating chamber 29 in each of the male terminals 21. As illustrated in FIGS. 4 and 6, the male terminal accommodating chamber 29 is formed by communicating an opening 47 which is open in a front end surface 45 of the base part 31 surrounded by the hood part 35 with a through hole 49 which penetrates the wire holding part 33 in the axial direction. A cylindrical male-side annular member 51 which protrudes forward from the circumferential edge of the opening 47 of the base part 31 to surround the opening 47 is provided inside the hood part 35.

As illustrated in FIG. 3, the male housing 17 has a lock arm 53 which extends forward in the axial direction along the outer surface in a cantilever shape. The lock arm 53 has two leg parts 57 respectively supported by a pair of wall parts 55 which stand upward from both surfaces of the base part 31 in the width direction, a base end part 59 which connects the leg parts 57 in the width direction, and an arm part 61 which extends forward from the base end part 59.

In the lock arm 53, the front end part of the arm part 61 is replaceable upward from a horizontal direction with the base end part 59 as a fulcrum. As illustrated in FIG. 6, a locking part 63 which protrudes downward is provided in the lower portion of the front end of the arm part 61. As illustrated in FIG. 3, the wall part 55 surrounds the lock arm 53 and is provided from the base part 31 of the male housing 17 over the wall part 39 of the hood part 35. The upper end surface of the lock arm 53 is set to have a height equal to or less than the height of the upper end surfaces of the wall parts 39 and 55.

As illustrated in FIG. 1, the male terminal 21 is formed of a conductive metal plate and the like, and integrally includes a wire connection part 65 which connects core wires of the wires 25 in a compressive contact manner, and a male tap 67 connected with the female terminal 23. The male tap 67 is formed in a rod shape to extend in the front and rear direction, and is provided to protrude from the front end surface 45 in a state where the male terminal 21 is held in the setting position of the male terminal accommodating chamber 29 and to extend forward from the front end of the male-side annular member 51.

Figure 5:
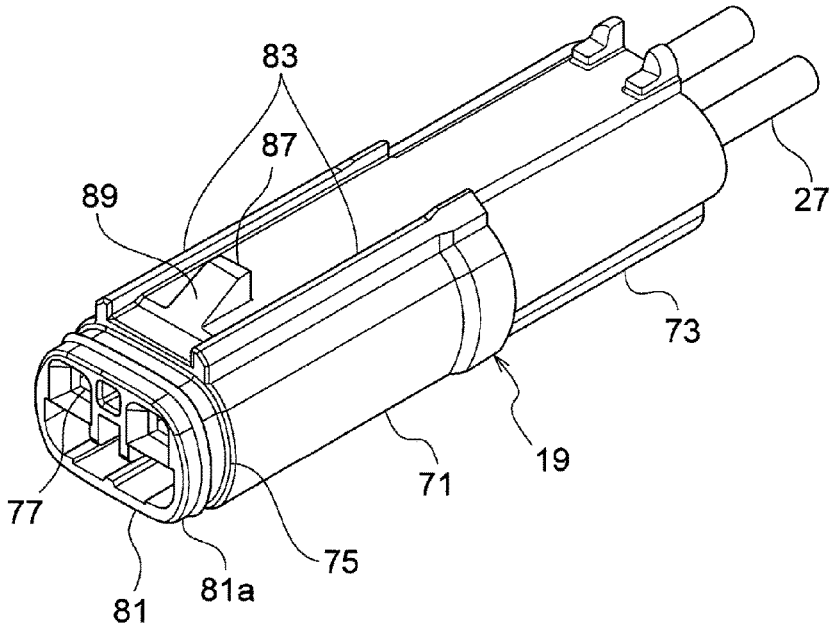
FIG. 5 is a perspective view of an appearance of the female connector.

On the other hand, as illustrated in FIG. 1, the female connector 15 has the female housing 19 formed of an insulating synthetic resin in a cylindrical shape and the female terminal 23 accommodated from the rear side by the female housing 19. As illustrated in FIGS. 5 and 6, the female housing 19 is formed such that a cross section orthogonal to the axial direction has an almost similar shape to the inner circumferential surface of the hood part 35 of the male housing 17, and integrally includes a base part 71 formed with two female terminal accommodating chambers 69 (cavity) into which the female terminals 23 are inserted, and a wire holding part 73 protruding rearward from the base part 71. The female terminal accommodating chamber 69 is formed such that two female terminals 23 are partitioned by a partition wall (not illustrated), and is held in the setting position by engaging a lance (not illustrated) extending into the female terminal accommodating chamber 69 in each of the female terminals 23.

As illustrated in FIGS. 5 and 6, the female terminal accommodating chamber 69 is formed by communicating the opening 77 which is open in the front end surface 75 of the base part 71 with the through hole 79 penetrating the wire holding part 73 in the axial direction. A cylindrical female-side annular member 81 which protrudes forward from the front end surface 75 to surround the opening 77 from the circumferential edge of the opening 77 is provided in the base part 71. The female-side annular member 81 is formed to have the outer circumferential surface 81*a* formed by reducing the outer circumferential surface of the base part 71 into a stepped shape.

As illustrated in FIG. 5, a pair of projection parts 83 which extend from the upper surface of the base part 71 in the axial direction and a stepped part 85 which extends from the lower surface of the base part 71 in the axial direction as illustrated in FIG. 6 are provided in the female housing 19. The pair of projection parts 83 are provided to be separated in the width direction, and each of the projection parts 83 can abut on the inner circumferential surface of the male housing 17. The locked part 87 protruding upward is provided inside the pair of the projection parts 83. A tilted surface 89 which is tilted downward to the base part 71 on the front side is provided in the locked part 87, and the lock arm 53 of the male housing 17 is pushed upward along the tilted surface 89 at the time of fitting both housings.

As illustrated in FIG. 1, the female terminal 23 is formed of a conductive metal plate and the like, and integrally includes a wire connection part 91 which connects the core wire of the wire 27 in a compressive contact manner, and a rectangular cylindrical electrical contacting part 93 in which the male tap 67 of the male terminal 21 is connected in an inserting manner. In the electrical contacting part 93, in a state where the female terminal 23 is held in the setting position of the female terminal accommodating chamber 69, a tip part is provided in a position which flushes with the opening 77 of the base part 71 or is retreated by a setting distance from the opening 77.

Figure 7:
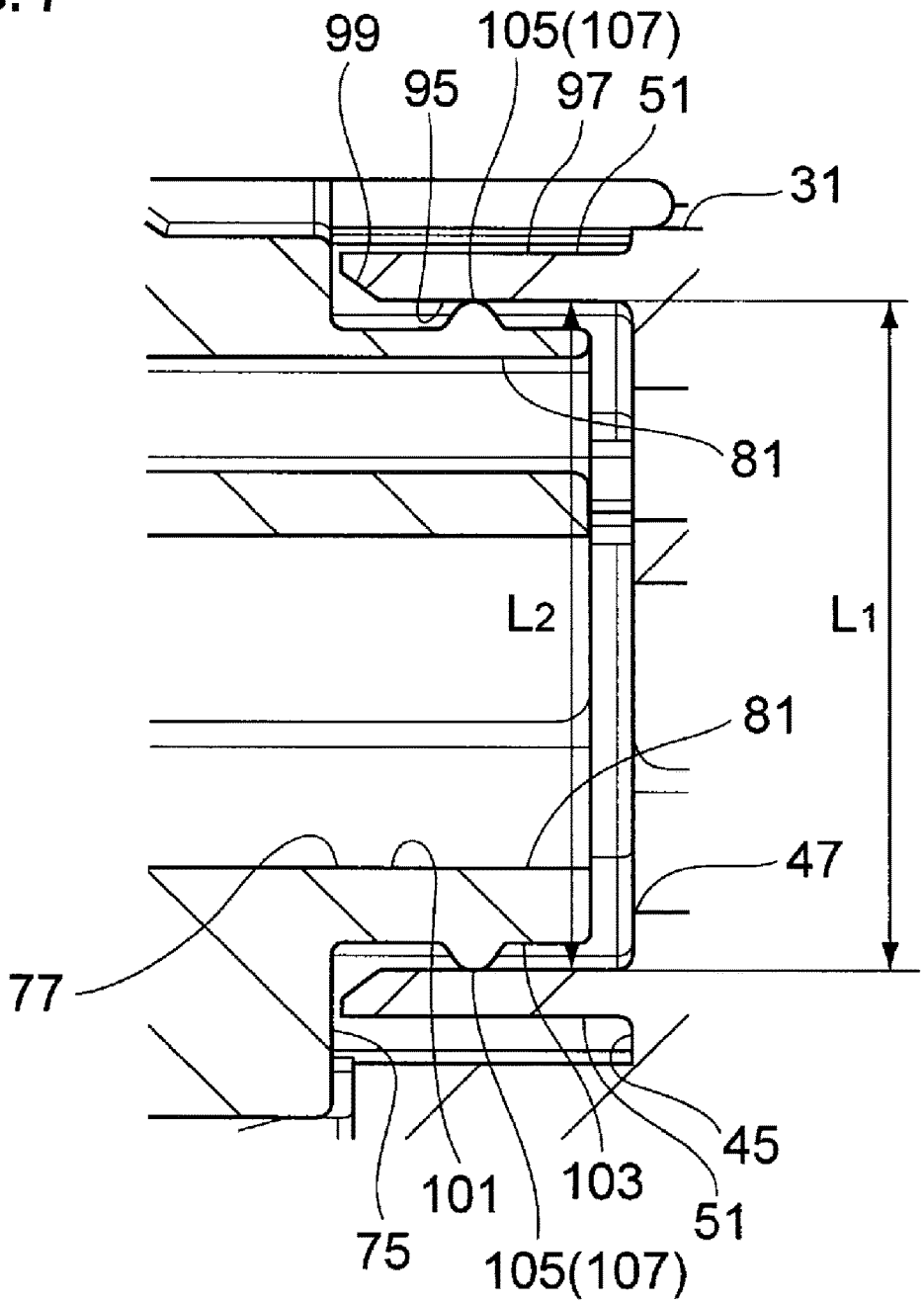
FIG. 7 is a partially enlarged view of FIG. 6.

Next, the description will be given about a specific configuration of this embodiment. In this embodiment, the female-side annular member 81 is fitted into the male-side annular member 51 at the time of fitting the male housing 17 and the female housing 19. FIG. 7 is a view obtained by enlarging the inside of the frame of FIG. 6.

The male-side annular member 51 is a resin member which extends in a cylindrical shape from the circumferential edge of the opening 47 of the base part 31 of the male housing 17, and has a higher elasticity than the female-side annular member 81. The male-side annular member 51 is formed in an elliptical cylindrical shape in which a cross section orthogonal to the axial direction of the male housing 17 has a longitudinal side in the width direction, has an inner circumferential surface 95 and an outer circumferential surface 97 which extend in parallel to the axis of the male housing 17, and has a uniform thickness in the axial direction. A tilted surface 99 which is tilted in a separating direction from the facing female-side annular member 81 to be widened forward is formed in the tip inner circumferential surface of the male-side annular member 51. The tilted surface 99 guides the female-side annular member 81 to the inside of the male-side annular member 51.

The female-side annular member 81 is a resin member which extends in a cylindrical shape from the circumferential edge of the opening 77 of the base part 71 of the female housing 19, and has a higher rigidity than the male-side annular member 51. The female-side annular member 81 has an inner circumferential surface 101 and an outer circumferential surface 103 which extend in parallel to the axis of the female housing 19, and an annular protrusion part 105 which protrudes over the entire circumference on the way from the front end (tip) of the outer circumferential surface 103 to the depth side. In the protrusion part 105, the cross section orthogonal to a circumferential direction is formed in an arc shape centered on a top part 107 abutting on the inner circumferential surface 95 of the male-side annular member 51 over the entire circumference. Incidentally, a protruding amount of the female-side annular member 81 protruding from the front end surface 75 in the axial direction is set to be shorter than a protruding amount of the male-side annular member 51 protruding the front end surface 45 in the axial direction.

In this embodiment, as illustrated in FIG. 7, when an inner dimension between the inner circumferential surfaces 95 facing each other in the height direction of the male-side annular member 51 is set as L1, and an outer dimension between the top parts of the protrusion part 105 facing each other in the height direction of the female-side annular member 81 is set as L2, L1 is set to be smaller than L2. Such a dimension relation is set over the entire circumference of the male-side annular member 51 and the female-side annular member 81. For this reason, when the protrusion part 105 of the female-side annular member 81 abuts on the inner circumferential surface 95, the inner circumferential surface 95 is pushed by the protrusion part 105, and the male-side annular member 51 is expanded to the outside over the entire circumference.

Figure 8:
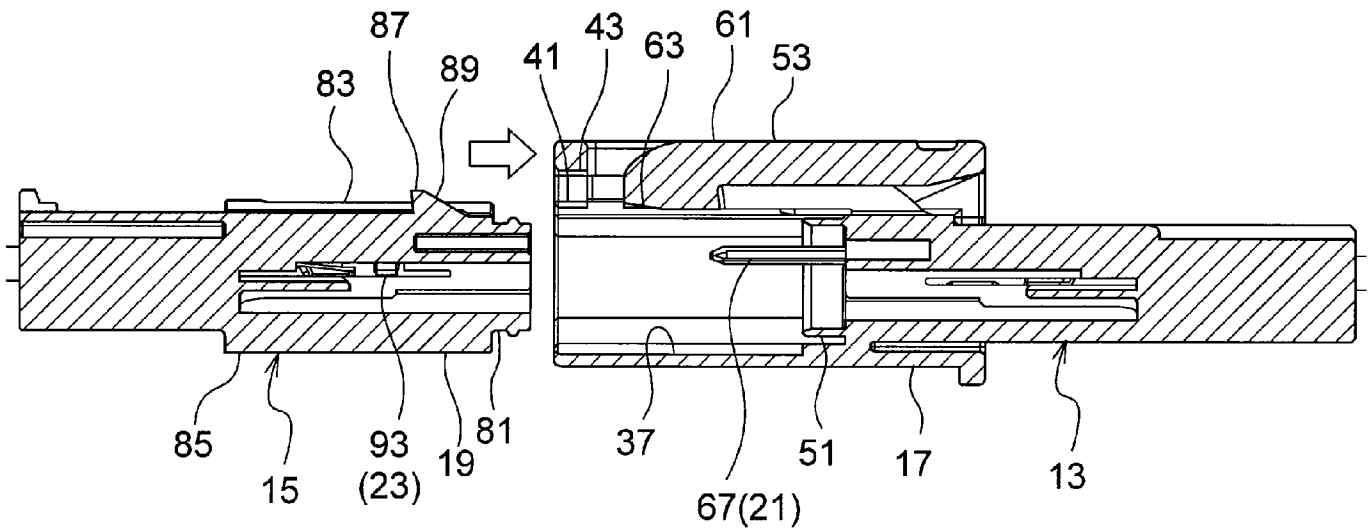
FIG. 8 is an operational view before the male connector and the female connector according to the first embodiment are fitted to each other.

Next, the description will be given about an assembly method of both housings and a fitting operation. First, as illustrated in FIG. 1, the male terminal 21 in which the wire 25 mounted with a rubber plug 108 is connected is accommodated by the male terminal accommodating chamber 29 of the male housing 17 together with the rubber plug 108. In addition, the female terminal 23 in which the wire 27 mounted with the rubber plug 110 is connected is accommodated by the female terminal accommodating chamber 69 of the female housing 19 together with the rubber plug 110. In this state, as indicated by the arrow of FIG. 8, the female housing 19 of the female connector 15 is inserted to the male housing 17 of the male connector 13.

When the female housing 19 is inserted to the male housing 17, the pair of the projection parts 83 of the female housing 19 pass through the first notch parts 41 of the male housing 17 respectively, and the locked part 87 of the female housing 19 passes through the second notch part 43 of the male housing 17. In addition, the stepped part 85 of the female housing 19 is guided along the guide groove 37 of the male housing 17.

Subsequently, when the insertion of the female housing 19 is performed, the lock arm 53 of the male housing 17 is placed on the locked part 87 along the tilted surface 89 of the locked part 87 of the female housing 19, and the arm part 61 is bent and deformed upward. Further, the locking part 63 of the arm part 61 gets over the locked part 87, so that the arm part 61 returns elastically. Accordingly, the locked part 87 is locked in the locking part 63, and both housings are locked in a normal fitting state.

On the other hand, when the female-side annular member 81 is inserted to the male-side annular member 51, the protrusion part 105 which is guided inward along the tilted surface 99 of the male-side annular member 51 moves along the inner circumferential surface 95 of the male-side annular member 51, and as illustrated in FIG. 7, the top part 107 of the protrusion part 105 is stopped in the form of pressing the inner circumferential surface 95 over the entire circumference. The male-side annular member 51 pressed by the protrusion part 105 is deformed elastically in a direction in which the tip part is widened outward, and the elastic restoring force generated at that time presses the female-side annular member 81. Accordingly, the male-side annular member 51 and the female-side annular member 81 abut on each other watertightly over the entire circumference, and as a result, it can be prevented that water is infiltrated into the opening 47 of the male connector 13 and the opening 77 of the female connector 15. Incidentally, at the time of fitting (the surface), the tip surface of the male-side annular member 51 and the female housing 19 are arranged apart, and the tip surface of the female-side annular member 81 and the male housing 17 are arranged apart.

As described above, in this embodiment, when the male connector 13 and the female connector 15 are fitted to each other, the male-side annular member 51 having an elasticity is pressed from the inside by the female-side annular member 81 having a relatively high rigidity and is expanded under an elastic limit. Thus, the gap between the male-side annular member 51 and the female-side annular member 81 is sealed without a plastic deformation, so as to prevent that water is infiltrated into the openings 47 and 77 and to improve the waterproof performance of the connector 11. In addition, the male-side annular member 51 and the female-side annular member 81 are sealed in a direct contact manner, so that the rubber packing and the like for maintaining the watertightness are not necessary, and the connector inner space can be set to be small. Thus, miniaturization and cost reduction of the connector 11 can be achieved.

The male-side annular member 51 is formed to have an elasticity (spring property), and is pressed by the female-side annular member 81 over the entire circumference. Thus, it is possible to suppress excessive deformation, and to prevent plastic deformation or breakage of the connector 11. Further, although the distance and the like between the male-side annular member 51 and the female-side annular member 81 (hereinafter, referred to as "annular members 51 and 81") are displaced due to the vibration delivered to the connector 11, the male-side annular member 51 is deformed elastically while contacting the protrusion part 105 of the female-side annular member 81, and thus the vibration is absorbed between the annular members so as to suppress the time degradation of the connector 11 associated with the vibration.

Additionally, in this embodiment, when the protrusion part 105 is formed on the way from the tip of the female-side annular member 81 to the depth side, a range where the male-side annular member 51 contacts the female-side annular member 81 can be limited to the top part 107 of the protrusion part 105, and the friction between the female-side annular member 81 and the male-side annular member 51 can be made small. Accordingly, the insertion load of inserting the female housing 19 to the male housing 17 can be reduced, and thus, the operability at the time of assembling the connector 11 can be improved.

In this embodiment, when the female housing 19 is inserted to the male housing 17, the pair of the projection parts 83 abut on the inner circumferential surface of the male housing 17, and the stepped part 85 is guided along the guide groove 37 of the male housing 17. Accordingly, a relative position deviation of the male housing 17 and the female housing 19 is suppressed so that the female-side annular member 81 can be allowed to contact the setting position of the male-side annular member 51. Thus, the adhesiveness of the annular members 51 and 81 can be improved to stabilize a waterproof property.

In this embodiment, the description has been given about an example in which when the male connector 13 and the female connector 15 are fitted to each other, the front end part of the female-side annular member 81 which is inserted to the male-side annular member 51 is set to be in non-contact with the front end surface 45 of the male housing 17, and the front end part of the male-side annular member 51 is set to be in non-contact with the front end surface 75 of the female housing 19. However, the tip part of any one annular member may be set to be formed to abut on the counterpart housing (for example, the front end surfaces 45 and 75). Accordingly, the tip part of the any one annular member abuts on the counterpart housing to function as a stopper. Thus, the relative movement of the male-side annular member 51 and the female-side annular member 81 is stopped to prevent damage and the like caused by excessive pressing between the annular members. In addition, the contact area of both housings can be increased so as to improve the waterproof property.

Figure 9:
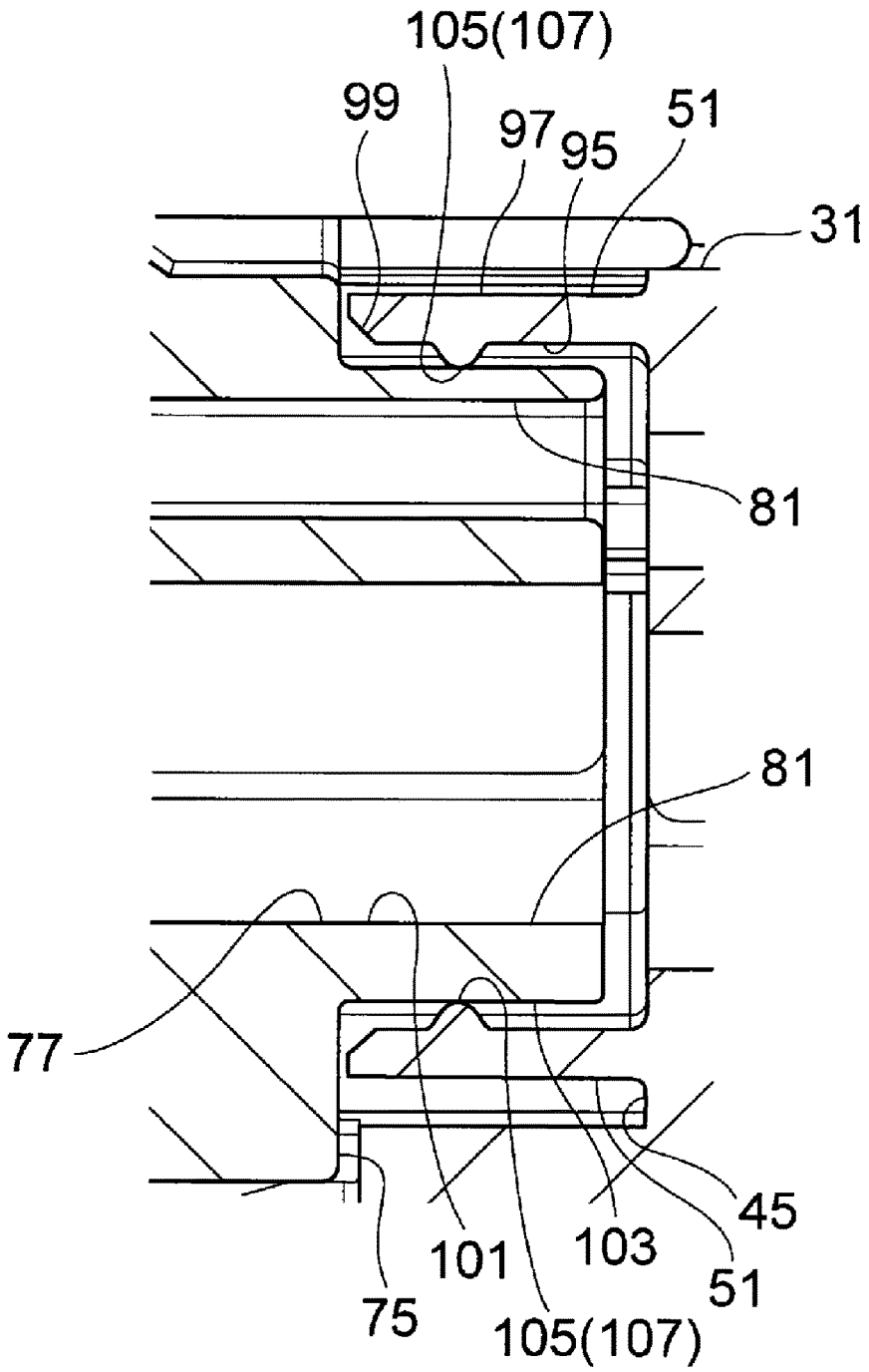
FIG. 9 is an enlarged view of another main portion corresponding to FIG. 7.

In this embodiment, the description has been given about an example in which the protrusion part 105 formed in the female-side annular member 81 presses the inner circumferential surface 95 of the male-side annular member 51. However, the protrusion part 105 may be formed in the male-side annular member 51 instead of the female-side annular member 81. That is, for example, as illustrated in FIG. 9, the outer circumferential surface 103 of the female-side annular member 81 may be configured to press the protrusion part 105 formed in the inner circumferential surface 95 of the male-side annular member 51 over the entire circumference.

Also in such a configuration, it is possible to obtain the same effect as the case of FIG. 7.

Incidentally, in this embodiment, the description has been given about an example in which the female-side annular member 81 is inserted to the male-side annular member 51. However, instead thereof, the male-side annular member 51 may be configured to be inserted to the female-side annular member 81. In this case, the protrusion part 105 is formed in any one of the outer circumferential surface 97 of the male-side annular member 51 and the inner circumferential surface 101 of the female-side annular member 81.

(Second Embodiment)

Hereinafter, a waterproof structure for a connector according to a second embodiment of the invention will be described with reference to the drawings. However, this embodiment is basically similar to the first embodiment. Therefore, hereinafter, only characteristic configuration of this embodiment will be described, and the common configuration with the first embodiment will not be described.

Figure 10:
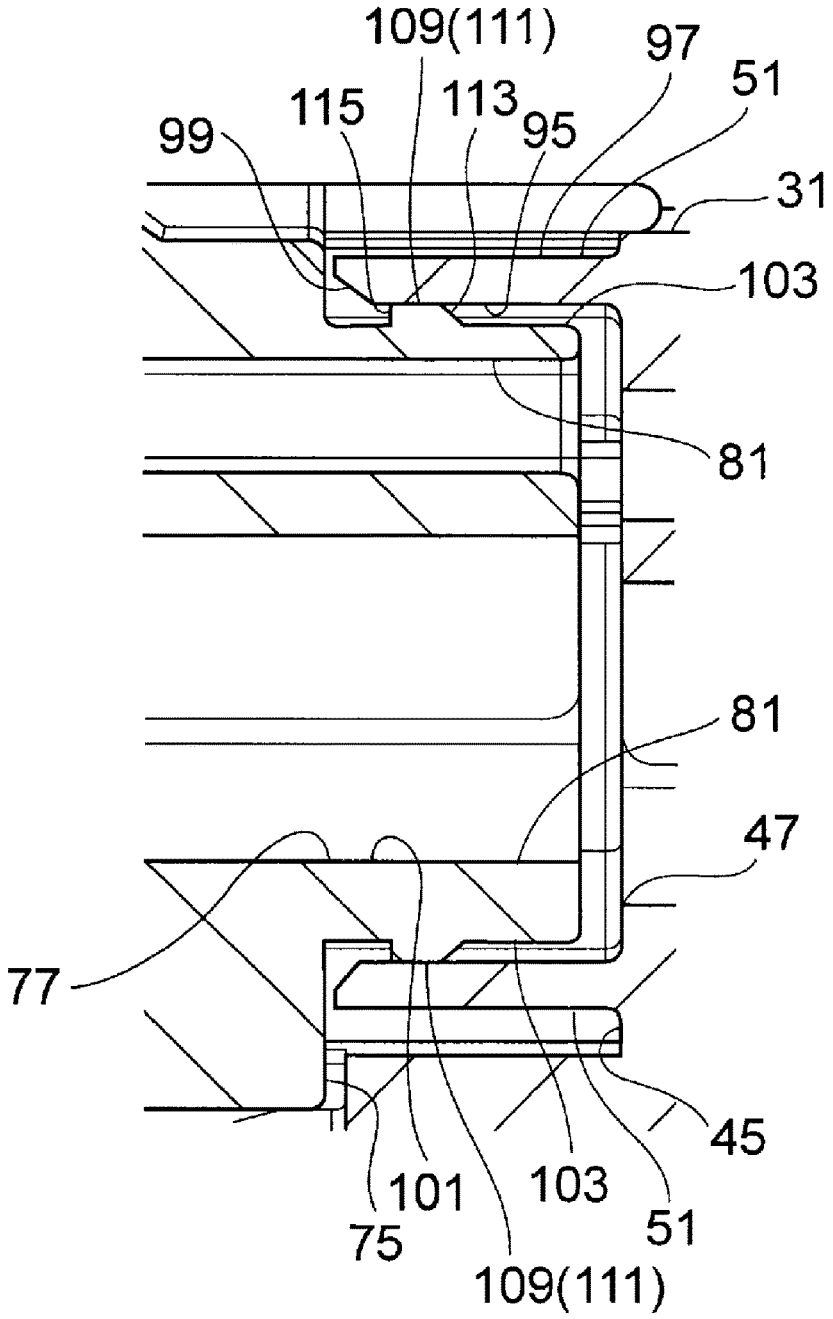
FIG. 10 is an enlarged view of a main portion of a second embodiment.

FIG. 10 is an enlarged view of main portions of this embodiment corresponding to FIG. 7. As illustrated in FIG. 10, the waterproof structure for a connector of this embodiment is different from the waterproof structure for a connector (FIG. 7) of the first embodiment in that the cross section orthogonal to the circumferential direction of the protrusion part 109 protruding from the outer circumferential surface 103 of the female-side annular member 81 is formed in a trapezoidal shape, and a tilted surface 113 is provided which is tilted from a top part 111 which presses the inner circumferential surface 95 of the male-side annular member 51 toward the tip of the female-side annular member 81.

The protrusion part 109 is formed in an annular shape to have the tilted surface 113, a rear end surface 115 which stands almost perpendicularly from the outer circumferential surface 103 of the female-side annular member 81, and the top part 111 which extends in a direction orthogonal to the circumferential direction of the protrusion part 109. Similarly to the protrusion part 105 of FIG. 7, the protrusion part 109 is formed on the way from the tip of the female-side annular member 81 to the depth side. Incidentally, the cross section of the tilted surface 113 is not limited to a linear shape, and may be formed in an arc shape.

The total area of the top part 111 abutting on the male-side annular member 51 of the protrusion part 109 is larger than the total area of the protrusion part 105 having an arc-shaped cross section where the protrusion part 105 of FIG. 7 abuts on the male-side annular member 51. Accordingly, the strength (rigidity) of the protrusion part 109 of this embodiment can be improved compared to the protrusion part 105 of FIG. 7, and the plastic deformation can be prevented at time of pressing the inner circumferential surface 95 of the male-side annular member 51. Therefore, the adhesiveness between the male-side annular member 51 and the female-side annular member 81 is maintained so as to continuously prevent that water is infiltrated into the openings 47 and 77, and to improve the waterproof performance of the connector 11.

The tilted surface 113 is formed over the entire circumference on the front side of the protrusion part 109, and thus the male-side annular member 51 can be placed on the protrusion part 109 along the tilted surface 113. Accordingly, the impact generated when the male-side annular member 51 contacts the female-side annular member 81 is alleviated so that the plastic deformation or breakage of the annular members 51 and 81 can be prevented reliably.

Figure 11:
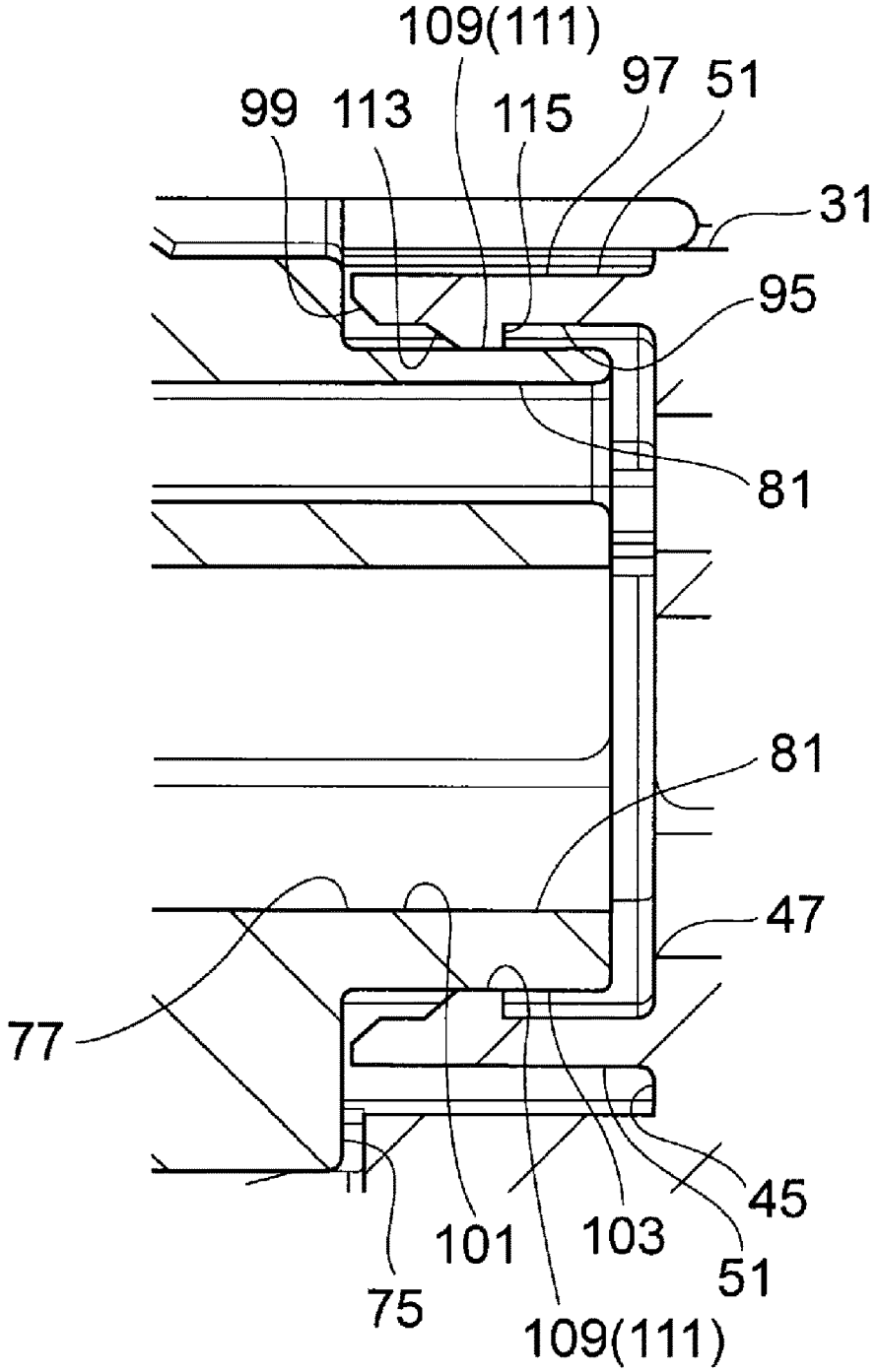
FIG. 11 is an enlarged view of a main portion of another embodiment corresponding to FIG. 10.

In this embodiment, the description has been given about an example in which the protrusion part 109 formed in the female-side annular member 81 presses the inner circumferential surface 95 of the male-side annular member 51. However, the protrusion part 109 may be formed in the male-side annular member 51 instead of the female-side annular member 81. That is, for example, as illustrated in FIG. 11, the outer circumferential surface 103 of the female-side annular member 81 may be configured to press the protrusion part 109 formed in the inner circumferential surface 95 of the male-side annular member 51 over the entire circumference. Also in such a configuration, it is possible to obtain the same effect as the case of FIG. 10.

(Third Embodiment)

Hereinafter, a waterproof structure for a connector according to a third embodiment of the invention will be described with reference to FIGS. 12 to 16. The waterproof structure for a connector according to the third embodiment is different from that of the first embodiment only in the shape of the protrusion part provided in the male-side annular member 51 and the female-side annular member 81. In this regard, hereinafter, the description will be given mainly about the difference.

Figure 12:
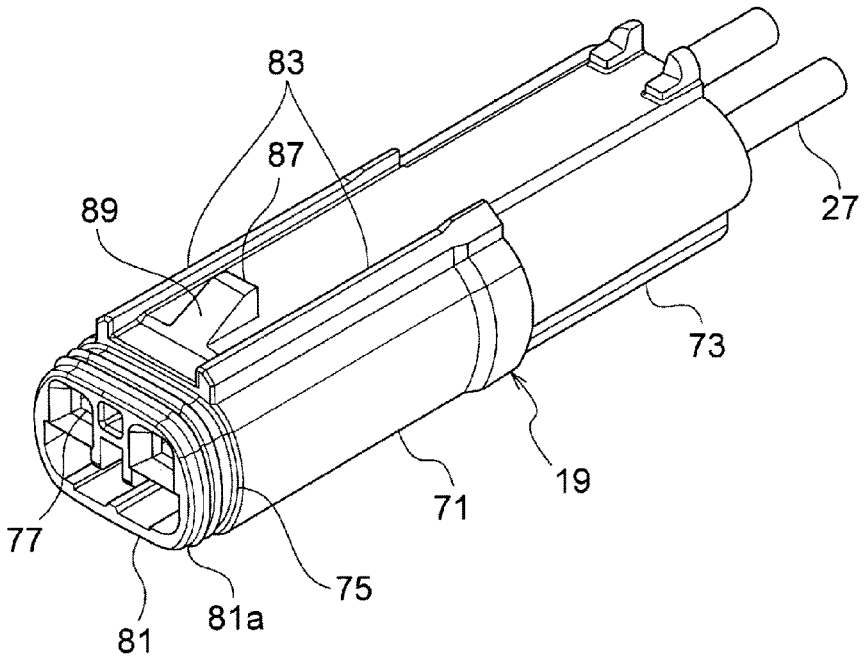
FIG. 12 is a perspective view of an appearance of a female connector according to a third embodiment.
Figure 13:
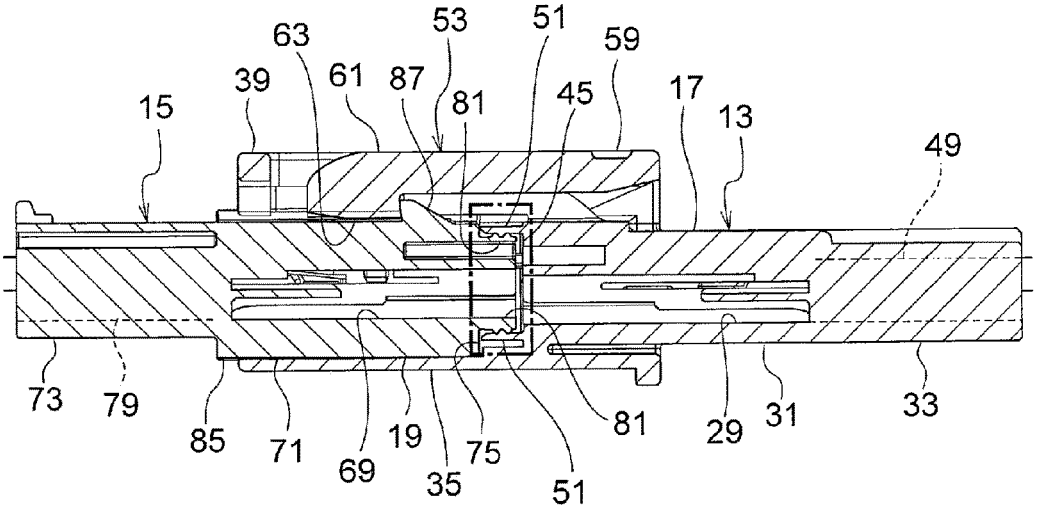
FIG. 13 is a sectional view of the female connector of FIG. 12 corresponding to the sectional view taken along line A-A of FIG. 2.
Figure 14:
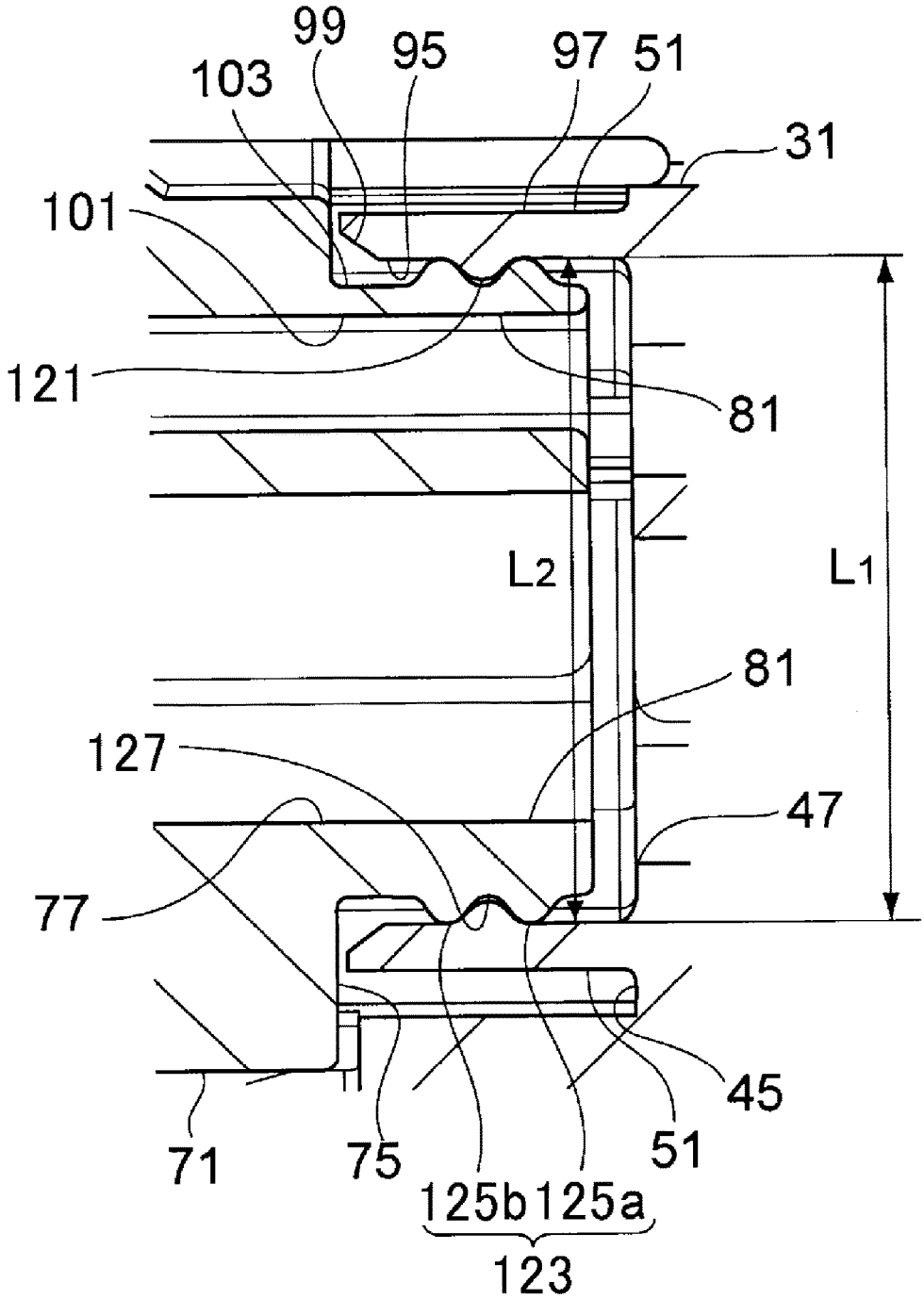
FIG. 14 is a partially enlarged view of FIG. 13.

In this embodiment, when the male housing 17 and the female housing 19 are fitted, the female-side annular member 81 is fitted into the male-side annular member 51. FIG. 14 is a view obtained by enlarging the inside of the frame of FIG. 13 (a sectional view in a state where the male housing 17 and the female housing 19 illustrated in the perspective view of FIG. 12 are fitted).

The male-side annular member 51 is a resin member which extends in a cylindrical shape from the circumferential edge of the opening 47 of the base part 31 of the male housing 17, and has a higher elasticity than the female-side annular member 81. The male-side annular member 51 is formed in an elliptical cylindrical shape in which the cross section orthogonal to the axial direction of the male housing 17 has a longitudinal side in the width direction, and has the inner circumferential surface 95 and the outer circumferential surface 97 which extend in the axial direction of the male housing 17. The inner circumferential surface 95 has an annular first protrusion part 121 which protrudes to the position of contacting the outer circumferential surface 103 of the female-side annular member 81, and the first protrusion part 121 is formed over the circumferential direction such that the cross section in the width direction (axial direction) has an arc shape. The tilted surface 99 which is tilted in a separating direction from the facing female-side annular member 81 to be widened forward is formed in the tip inner circumferential surface of the male-side annular member 51. The tilted surface 99 guides the female-side annular member 81 to the inside of the male-side annular member 51.

The female-side annular member 81 is a resin member which extends in a cylindrical shape from the circumferential edge of the opening 77 of the base part 71 of the female housing 19, and has a higher rigidity than the male-side annular member 51. The female-side annular member 81 has the inner circumferential surface 101 and the outer circumferential surface 103 which extend in the axial direction of the female housing 19. The outer circumferential surface 103 has an annular second protrusion part 123 which protrudes to the position of contacting the inner circumferential surface 95 of the male-side annular member 51.

As illustrated in FIG. 14, the second protrusion part 123 has two crest parts 125*a* and 125*b*, and is formed such that the cross section in the width direction is a sinusoidal curved surface in which the crest part 125 and a valley part 127 are repeated alternately. The crest parts 125*a* and 125*b* protrudes to the position of contacting the inner circumferential surface 95 of the male-side annular member 51, and are arranged in a position of being deviated from the first protrusion part 121 when the male housing 17 and the female housing 19 are fitted to a normal position. In this case, the first protrusion part 121 is arranged in the position of the valley part 127 between the adjacent crest parts 125*a* and 125*b*, and both sides in the width direction abut on the crest parts 125*a* and 125*b* of the outer circumferential surface 103, respectively.

In this embodiment, as illustrated in FIG. 14, when the inner dimension between the inner circumferential surfaces 95 facing each other in the height direction of the male-side annular member 51 is set as L1, and an outer dimension between the top parts of the second protrusion part 123 (crest parts 125*a* and 125*b*) of the female-side annular member 81 is set as L2, L1 is set to be smaller than L2. Such a dimension relation is set over the entire circumference of the male-side annular member 51 and the female-side annular member 81. For this reason, when the second protrusion part 123 of the female-side annular member 81 abuts on the inner circumferential surface 95, the inner circumferential surface 95 is pushed by the second protrusion part 123, and the male-side annular member 51 is expanded to the outside over the entire circumference.

Figure 15:
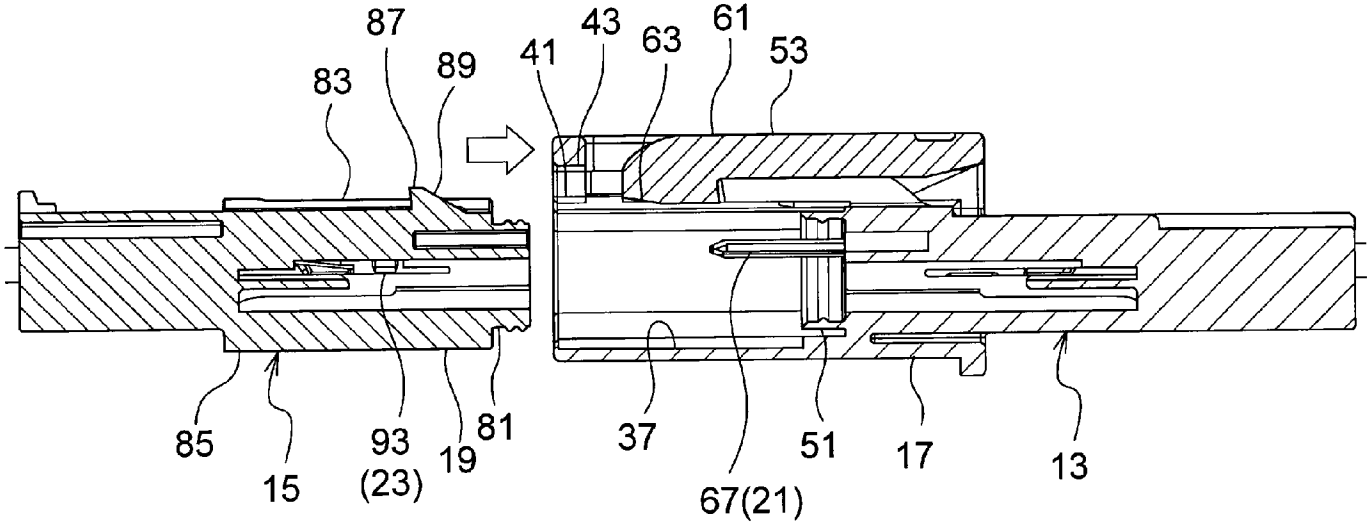
FIG. 15 is an operational view before a male connector and the female connector according to the third embodiment are fitted to each other.
Figure 16:
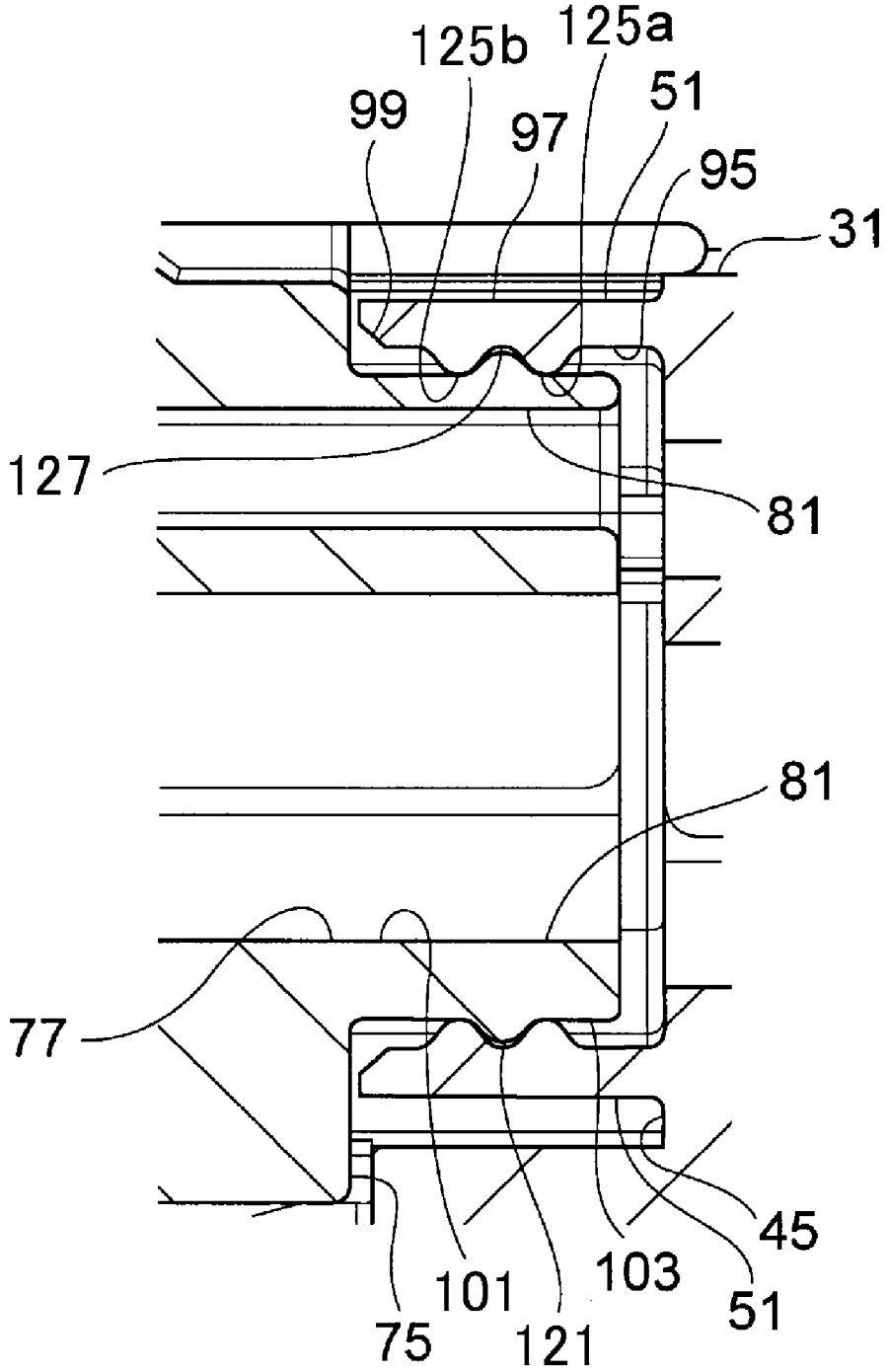
FIG. 16 is an enlarged view of another main portion corresponding to FIG. 14.

As illustrated in FIGS. 15 and 16, at the time of fitting both housings, when the female-side annular member 81 is inserted to the male-side annular member 51, the second protrusion part 123 guided inward along the tilted surface 99 of the male-side annular member 51 moves while pushing the inner circumferential surface 95 of the male-side annular member 51. As illustrated in FIG. 14, the first protrusion part 121 is positioned between the crest parts 125*a* and 125*b*, and the second protrusion part 123 stops in the form of pressing the inner circumferential surface 95 over the entire circumference. In the male-side annular member 51 pressed by the second protrusion part 123, the tip part is deformed elastically in a direction to be widened outward, and the elastic restoring force generated at that time presses the female-side annular member 81. Accordingly, the male-side annular member 51 and the female-side annular member 81 watertightly abuts on the entire circumference, so as to prevent that water is infiltrated into the opening 47 of the male connector 13 and the opening 77 of the female connector 15, respectively. Incidentally, when the male housing 17 and the female housing 19 are fitted, the tip surface of the male-side annular member 51 and the female housing 19 are arranged apart, and the tip surface of the female-side annular member 81 and the male housing 17 are arranged apart.

As described above, in this embodiment, when the male connector 13 and the female connector 15 are fitted to each other, the male-side annular member 51 having an elasticity is pressed from the inside by the female-side annular member 81 having a relatively high rigidity and is expanded under an elastic limit. Thus, the gap between the male-side annular member 51 and the female-side annular member 81 is sealed without a plastic deformation. For this reason, it is possible to prevent that water is infiltrated into the openings 47 and 77 and to improve the waterproof performance of the connector 11. In addition, the male-side annular member 51 and the female-side annular member 81 are sealed in a direct contact manner, so that a waterproof rubber packing and the like are not necessary, and the inner space of the connector 11 can be set to be small. Thus, miniaturization and cost reduction of the connector 11 can be achieved.

In this embodiment, in the waterproof structure of the gap between the male-side annular member 51 and the female-side annular member 81, the first protrusion part 121 and the second protrusion part 123 are provided such that the positions are deviated from each other. Thus, it is possible to lengthen the depth length of the waterproof structure. Accordingly, a waterproof function of the waterproof structure can be improved, so as to more effectively prevent that water is infiltrated into the openings 47 and 77.

In this embodiment, when the male-side annular member 51 and the female-side annular member 81 are fitted to a normal position, the first protrusion part 121 is engaged between two crest parts 125*a* and 125*b* of the second protrusion part 123, so as to regulate a relative movement in the axial direction (front and rear direction) between the female-side annular member 81 and the male-side annular member 51, and to maintain such an overlapped state. Therefore, for example, when the connector 11 vibrates, the male-side annular member 51 and the female-side annular member 81 are integrally expanded and contracted, so as to absorb the vibration. Thus, it is possible to prevent the time degradation or the waterproof property deterioration of the connector 11 associated with the vibration.

In addition, in this embodiment, when the male housing 17 is inserted to the female housing 19, the pair of the projection parts 83 abut on the inner circumferential surface of the male housing 17, and the stepped part 85 is guided along the guide groove 37 of the male housing 17. Accordingly, the relative position deviation of the male housing 17 and the female housing 19 is suppressed so that the female-side annular member 81 can be allowed to contact the setting position of the male-side annular member 51 at a predetermined angle. Thus, the annular members 51 and 81 can be overlapped in a proper position so as to stabilize the waterproof property.

Incidentally, in this embodiment, the description has been given about an example in which when the male connector 13 and the female connector 15 are fitted to each other, the front end part of the female-side annular member 81 which is inserted to the male-side annular member 51 is set to be in non-contact with the front end surface 45 of the male housing 17, and the front end part of the male-side annular member 51 is set to be in non-contact with the front end surface 75 of the female housing 19. However, the tip part of any one annular member may be set to be formed to abut on the counterpart housing (for example, the front end surfaces 45 and 75). Accordingly, the tip part of the any one annular member abuts on the counterpart housing to function as a stopper. Thus, the relative movement of the male-side annular member 51 and the female-side annular member 81 is stopped to prevent damage and the like caused by excessive pressing between the annular members 51 and 81. In addition, the contact area of both housings can be increased so as to improve the waterproof property.

In this embodiment, the description has been given about an example in which the second protrusion part 123 of the female-side annular member 81 presses the male-side annular member 51 in the form of engaging the first protrusion part 121 of the male-side annular member 51. However, the positions of the first protrusion part 121 and the second protrusion part 123 may be configured to be switched. That is, as illustrated in FIG. 16, the first protrusion part 121 is formed in the outer circumferential surface 103 of the female-side annular member 81, and the second protrusion part 123 is formed in the inner circumferential surface 95 of the male-side annular member 51. Also in such a configuration, it is possible to obtain the same effect as the case of FIG. 14. Incidentally, in this embodiment, the description has been given about an example in which the female-side annular member 81 is inserted to the male-side annular member 51. However, instead of that, the male-side annular member 51 may be configured to be inserted to the female-side annular member 81.

(Fourth Embodiment)

Figure 17:
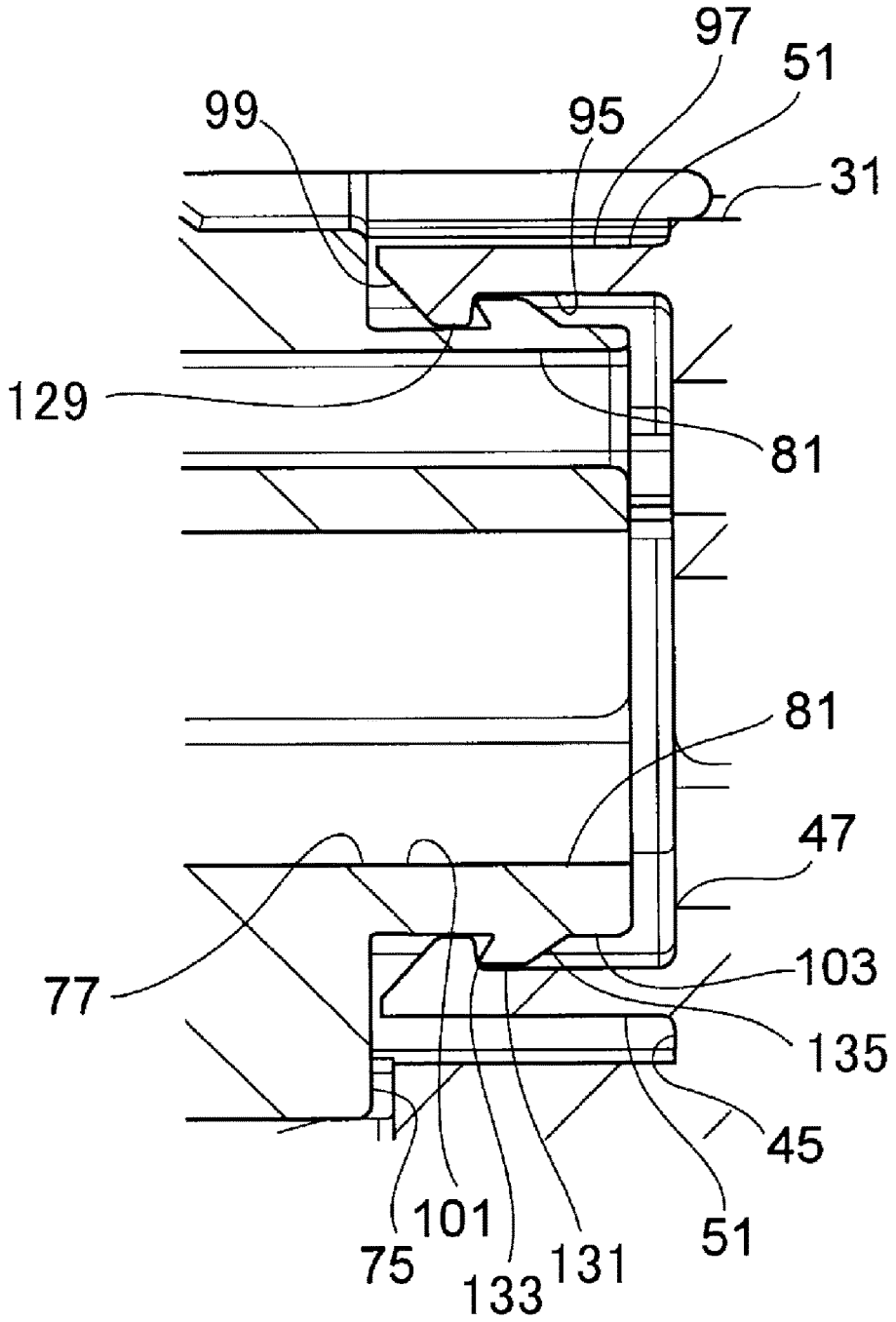
FIG. 17 is an enlarged view of a main portion of a fourth embodiment.

Hereinafter, a waterproof structure for a connector according to a fourth embodiment of the invention will be described with reference to the drawings. FIG. 17 is an enlarged view of main portions of the fourth embodiment corresponding to FIG. 14.

The waterproof structure for a connector of this embodiment is different from the waterproof structure for a connector (FIG. 14) of a fifth embodiment in that when the male housing 17 and the female housing 19 are fitted to a normal position, the annular second protrusion part 131 protruding from the outer circumferential surface 103 of the female-side annular member 81 is formed with respect to the annular first protrusion part 129 protruding from the inner circumferential surface 95 of the male-side annular member 51 only in a pulling-out direction of the male-side annular member 51.

In the first protrusion part 129, the cross section of the width direction is formed in a trapezoidal shape, and the first protrusion part 129 protrudes to the position of contacting the outer circumferential surface 103 of the female-side annular member 81. The first protrusion part 129 is provided in the front end part of the male-side annular member 51, and is formed in a shape to regulate the movement of the second protrusion part 131 in a pulling-out direction (the left direction of FIG. 17). The tilted surface which extends along the tilted surface 99 is formed in the front side of the first protrusion part 129.

In the second protrusion part 131, the cross section of the width direction is formed in a trapezoidal shape, and the second protrusion part 131 protrude to the position of contacting the inner circumferential surface 95 of the male-side annular member 51. When the male housing 17 and the female housing 19 are fitted to a normal position, the second protrusion part 131 is arranged to the rear side of the first protrusion part 129 of the male-side annular member 51, and is formed in a shape to regulate the movement of the first protrusion part 129 in the pulling-out direction (the right direction of FIG. 17). In this embodiment, the second protrusion part 131 is formed to be tilted to the rear side of the female-side annular member 81, that is, toward the first protrusion part 129, and a corner part 133 in a direction to be tilted when the male housing 17 and the female housing 19 are fitted to a normal position presses the first protrusion part 129.

The second protrusion part 131 has a tilted surface 135 which is tilted from the top part to the front side of the female-side annular member 81. Accordingly, in the second protrusion part 131, when the male housing 17 and the female housing 19 are fitted, the first protrusion part 129 is placed on the second protrusion part 131 along the tilted surface 135, so as to get over the second protrusion part 131. Incidentally, the corner part 133 of the second protrusion part 131 abuts on the rear side of the first protrusion part 129 which gets over the second protrusion part 131, and thus the second protrusion part 131 cannot be easily got over although an external force is applied in the pulling-out direction.

In this embodiment, the first protrusion part 129 and the second protrusion part 131 are positioned in a direction to pull out the annular members 51 and 81. Further, the first protrusion part 129 and the second protrusion part 131 are formed in a shape to regulate the movement of the counterpart in the pulling-out direction, so that the male-side annular member 51 and the female-side annular member 81 can maintain reliably a state of being overlapped with each other. Therefore, the adhesiveness of the male-side annular member 51 and the female-side annular member 81 is maintained so as to continuously prevent that water is infiltrated into the openings 47 and 77.

In addition, also in this embodiment, in the waterproof structure of the gap of the male-side annular member 51 and the female-side annular member 81, the first protrusion part 129 and the second protrusion part 131 are provided to be deviated in position from each other so as to lengthen the depth length of the waterproof structure. Thus, it is possible to improve the waterproof property of the gap of the male-side annular member 51 and the female-side annular member 81.

(Fifth Embodiment)

Figure 18:
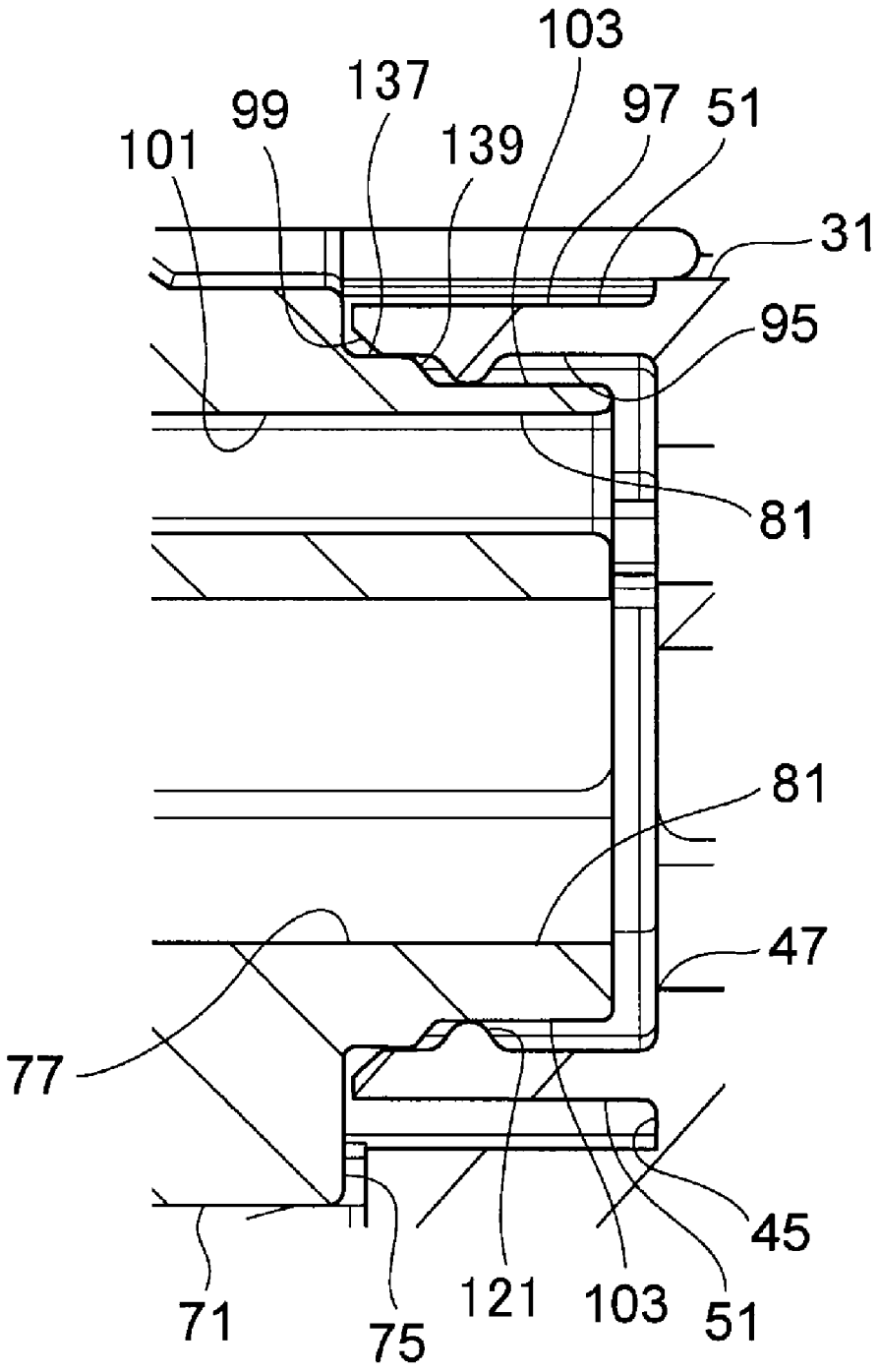
FIG. 18 is an enlarged view of a main portion of a fifth embodiment.

FIG. 18 is an enlarged view of main portions of the fifth embodiment corresponding to FIG. 14. The waterproof structure for a connector of this embodiment is different from the waterproof structure for a connector (FIG. 14) of the fifth embodiment in that when the male housing 17 and the female housing 19 are fitted to a normal position, the annular second protrusion part 137 protruding from the outer circumferential surface 103 of the female-side annular member 81 is formed with respect to the annular first protrusion part 121 protruding from the inner circumferential surface 95 of the male-side annular member 51 only in the opposite side of the pulling-out direction of the male-side annular member 51.

The first protrusion part 121 is formed is the same shape as that of the fifth embodiment. The second protrusion part 137 is formed by protruding the base end part of the depth side of the outer circumferential surface 103 of the female-side annular member 81 to the position of contacting the inner circumferential surface 95 of the male-side annular member 51 in a stepped shape. The second protrusion part 137 has a tilted surface 139 which is tilted from the top part toward the outer circumferential surface 103.

In this embodiment, as illustrated in FIG. 18, when the male housing 17 and the female housing 19 are fitted to the normal position, the first protrusion part 121 presses the way from the second protrusion part 137 (base end part) of the outer circumferential surface 103 of the female-side annular member 81 toward the front end part, and the second protrusion part 137 is set to press the front end part of the inner circumferential surface 95 of the male-side annular member 51.

Similarly to the above-described embodiments, in this embodiment, a structure is not provided which regulates the movement of each of the male-side annular member 51 and the female-side annular member 81 in a pulling direction. However, the movement of the first protrusion part 121 and the second protrusion part 137 to the stop position at the time of fitting the male housing 17 and the female housing 19 becomes smooth to that extent. Thus, it is possible to reduce the insertion load of inserting the female housing 19 to the male housing 17, and to improve the operability at the time of assembling the connector 11.

Also in this embodiment, in the waterproof structure of the gap of the male-side annular member 51 and the female-side annular member 81, the first protrusion part 121 and the second protrusion part 137 are provided to be deviated in position from each other so as to lengthen the depth length of the waterproof structure. Thus, it is possible to improve the waterproof property of the gap of the male-side annular member 51 and the female-side annular member 81.

Hereinbefore, the invention has been described in detail with reference to a specific embodiment. However, it is clear for those skilled in the art that it is possible to perform various alterations or modifications without departing from the spirit and range of the invention.

Herein, the features of the embodiments of the waterproof structure for a connector according to the above-described invention is concisely summarized as follows.

(1) A waterproof structure for a connector which prevents that water is infiltrated into openings of terminal accommodating cavities (29 and 69) which are respectively formed in a pair of housings (17 and 19) fitted to each other, in which the pair of housings include annular members (51 and 81) protruding in a fitting direction to surround the opening, the annular member (81) of one housing being inserted into an annulus of the annular member (51) of the other housing at a time of fitting, and the at least one annular member (81) includes a protrusion part (105) which is an annular protrusion part (105) protruding toward the other annular member (51) and has a top part (107) which is pressed by a surface of the other annular member (51) at the time of fitting.

(2) The waterproof structure for a connector according to the above-described (1), in which the protrusion part (105) is formed such that a sectional shape of the top part in a cross section orthogonal to a circumferential direction of the annular member (81) is an arc shape.

(3) The waterproof structure for a connector according to the above-described (1) or (2), in which the protrusion part (109) includes a tilted surface (113) which is tilted from the top part (111) toward a protruding end of the annular member (81).

(4) The waterproof structure for a connector according to any one of the above-described (1) to (3), in which an inner circumferential surface (95) of one annular member (51) is formed with an annular first protrusion part (121) which protrudes to contact an outer circumferential surface (103) of the other annular member (81), the outer circumferential surface (103) of the other annular member (81) is formed with an annular second protrusion part (123) which protrudes to contact the inner circumferential surface (95) of the one annular member (51), and the first protrusion part (121) and the second protrusion part (123) are arranged to be deviated from each other at the time of fitting.

(5) The waterproof structure for a connector according to the above-described (4), in which any one of the first protrusion part (129) and the second protrusion part (131) has a shape (133) which regulates movement of the other in a fitting release direction at the time of fitting.

(6) The waterproof structure for a connector according to the above-described (4) or (5), in which any one (123) of the first protrusion part (121) and the second protrusion part (123) has a sectional shape which has a plurality of crest parts (125*a* and 125*b*) in a cross section orthogonal to a circumferential direction thereof, and the other (121) of the first protrusion part and the second protrusion part is positioned in a valley part (127) between the adjacent crest parts (125*a* and 125*b*) at the time of fitting.

(7) The waterproof structure for a connector according to any one of the above-described (4) to (6), in which any one (137) of the first protrusion part (121) and the second protrusion part (137) is formed in a connecting end of the annular member (81) with a main body (71) of the housing (19), and the other (121) of the first protrusion part and the second protrusion part presses the surface (103) of the annular member (81) between the connecting end and the protruding end of the annular member (81).

This application is based upon and claims the benefit of priority from Japanese Patent Application No. 2015-170926 filed Aug. 31, 2015 and Japanese Patent Application No. 2015-171305 filed Aug. 31, 2015, the entire contents of which are incorporated herein by reference.

INDUSTRIAL APPLICABILITY

According to the invention, it is possible to achieve improvement for a waterproof performance at the time of fitting housings and to miniaturize a connector. The invention with such an effect is effectively applied to a waterproof structure for a connector.

REFERENCE SIGNS LIST

11: connector
13: male connector
15: female connector
17: male housing
19: female housing
21: male terminal
23: female terminal
29: male terminal accommodating chamber (cavity)
47, 77: opening
51: male-side annular member
69: female terminal accommodating chamber (cavity)
71: base part (main body)
81: female-side annular member
95,101: inner circumferential surface
97,103: outer circumferential surface (surface)
105, 109: protrusion part
107, 111: top part
113: tilted surface
121, 129: first protrusion part
123, 131, 137: second protrusion part
127: valley part

The invention claimed is:

1. A waterproof structure for a connector which prevents that water is infiltrated into openings of terminal accommodating cavities which are respectively formed in a pair of housings fitted to each other, wherein one of the pair of the housings includes:

a base part formed with the terminal accommodating cavity;

a hood part protruding forward from the base part; and an annular member having a cylindrical shape and protruding forward to surround the opening at an inner side of the hood part from a circumferential edge of the opening formed at a front end surface of the base part surrounded by the hood part, the annular member being separated from and extending within the hood part with a space formed therebetween, the other of the pair of the housings includes:

a base part formed to have a similar shape to an inner circumferential surface of the hood part and formed with the terminal accommodating cavity; and an annular member having a cylindrical shape and protruding forward to surround the opening from a circumferential edge of the opening formed at a front end surface of the base part, the annular member of one housing being inserted into an annulus of the annular member of the other housing at a time of fitting, and at least one of the annular members includes a protrusion part which is an annular protrusion part protruding toward the other annular member and has a top part which is pressed by a surface of the other annular member at the time of fitting, wherein the at least one of the annular members is expanded into the space to overlap the other annular member without pressing against the hood part.

2. The waterproof structure for a connector according to claim 1, wherein the protrusion part is formed such that a sectional shape of the top part in a cross section orthogonal to a circumferential direction of the annular member is an arc shape.

3. The waterproof structure for a connector according to claim 1, wherein the protrusion part includes a tilted surface which is tilted from the top part toward a protruding end of the annular member.

4. The waterproof structure for a connector according to claim 1, wherein an inner circumferential surface of one annular member is formed with the protrusion part as an annular first protrusion part which protrudes to contact an outer circumferential surface of the other annular member, the outer circumferential surface of the other annular member is formed with an annular second protrusion part which protrudes to contact the inner circumferential surface of the one annular member, and the first protrusion part and the second protrusion part are arranged to be deviated from each other at the time of fitting.

5. The waterproof structure for a connector according to claim 4, wherein any one of the first protrusion part and the second protrusion part has a shape which regulates movement of the other in a fitting release direction at the time of fitting.

6. The waterproof structure for a connector according to claim 4, wherein any one of the first protrusion part and the second protrusion part has a sectional shape which has a plurality of crest parts in a cross section orthogonal to a circumferential direction thereof, and the other of the first protrusion part and the second protrusion part is positioned in a valley part between the adjacent crest parts at the time of fitting.

7. The waterproof structure for a connector according to claim 4, wherein any one of the first protrusion part and the second protrusion part is formed in a connecting end of the annular member with a main body of the housing, and the other of the first protrusion part and the second protrusion part presses the surface of the annular member between the connecting end and the protruding end of the annular member.

* * * * *